US009573747B2

(12) United States Patent
Koland et al.

(10) Patent No.: US 9,573,747 B2
(45) Date of Patent: Feb. 21, 2017

(54) FOLDED LINER FOR USE WITH AN OVERPACK AND METHODS OF MANUFACTURING THE SAME

(71) Applicant: Entegris, Inc., Billerica, MA (US)

(72) Inventors: Amy Koland, Eden Prairie, MN (US); Richard Chism, Round Rock, TX (US)

(73) Assignee: ENTEGRIS, INC., Billerica, MA (US)

( * ) Notice: Subject to any disclaimer, the term of this patent is extended or adjusted under 35 U.S.C. 154(b) by 0 days.

(21) Appl. No.: 14/712,583

(22) Filed: May 14, 2015

(65) Prior Publication Data

US 2015/0321820 A1 Nov. 12, 2015

Related U.S. Application Data

(63) Continuation of application No. 14/357,659, filed as application No. PCT/US2013/024324 on Feb. 1, 2013, now Pat. No. 9,067,718.

(Continued)

(51) Int. Cl.

*B65D 77/06* (2006.01)
*B31B 1/26* (2006.01)

(Continued)

(52) U.S. Cl.

CPC ..... *B65D 77/06* (2013.01); *B31B 1/26* (2013.01); *B65B 55/04* (2013.01); *B65D 25/16* (2013.01); *B65D 25/18* (2013.01); *B65D 77/065* (2013.01); *B31B 2217/0053* (2013.01)

(58) Field of Classification Search

CPC .... B65D 77/068; B65D 77/065; B65D 77/06; B65D 77/04; B65D 31/10; B65D 25/18;

(Continued)

(56) References Cited

U.S. PATENT DOCUMENTS

2002/0005244 A1 1/2002 Rosenberg et al.
2008/0035519 A1 2/2008 Swartz et al.
2009/0127153 A1 5/2009 Kim

FOREIGN PATENT DOCUMENTS

AU 9052029 9/1990
CN 1237937 A 12/1999

(Continued)

OTHER PUBLICATIONS

ATMI Packaging, "Liner Folding and Labeling Specifications," Date Revised Jan. 28, 2008, 4 pgs.

*Primary Examiner* — Robert J Hicks

(74) *Attorney, Agent, or Firm* — Christensen Fonder P.A.

(57) ABSTRACT

A method for folding a liner for packaging and/or insertion into an overpack. The method may include providing a liner comprising a substantially tubular body portion and a closed top and bottom, and a fitment formed in or affixed to the top of the liner, forming a gusset in the bottom panel of the liner, forming a gusset in the body portion of the liner, and fan-folding the liner. In some embodiments, the top of the liner may be a substantially circular top panel and the bottom of the liner may be a substantially circular bottom panel, with the top panel being attached to one end of the tubular body portion and the bottom panel being attached to an opposite end of the tubular body portion. In other embodiments, the liner may be a flexible, blow molded liner, thereby having no weld seams.

22 Claims, 6 Drawing Sheets

Related U.S. Application Data

(60) Provisional application No. 61/595,481, filed on Feb. 6, 2012, provisional application No. 61/641,402, filed on May 2, 2012.

(51) Int. Cl.
*B65D 25/18* (2006.01)
*B65B 55/04* (2006.01)
*B65D 25/16* (2006.01)

(58) Field of Classification Search
CPC ..... B65D 25/16; B65D 25/14; B65B 55/04; B65B 55/02; B31B 1/26
USPC ..... 220/495.06, 495.01, 666; 222/105, 92; 53/449, 426; 383/114, 109, 120, 124, 383/123, 121
See application file for complete search history.

(56) References Cited

FOREIGN PATENT DOCUMENTS

| | | | |
|---|---|---|---|
| EP | 0105537 | A2 | 4/1984 |
| EP | 1 626 925 | B1 | 3/2007 |
| FR | 2895735 | | 7/2007 |
| GB | 1510490 | A | 5/1978 |
| JP | 02208332 | | 8/1990 |
| JP | 0664073 | | 3/1994 |
| JP | 06286778 | | 10/1994 |
| JP | 11268771 | | 10/1999 |
| JP | 2003-252376 | | 9/2003 |
| JP | 2007-537948 | | 12/2007 |
| JP | 2010-235197 | | 10/2010 |
| JP | 2011-126601 | | 6/2011 |
| WO | 99/64324 | A1 | 12/1999 |
| WO | WO 2011/006146 | | 1/2011 |

FOLDED LINER FOR USE WITH AN OVERPACK AND METHODS OF MANUFACTURING THE SAME

CROSS-REFERENCE TO RELATED APPLICATIONS

The present application is a continuation of U.S. patent application Ser. No. 14/357,659, filed May 13, 2014, which is a 371 of PCT/US2013/024324, filed Feb. 1, 2013, which claims the benefit of Provisional Application No. 61/595,481, filed Feb. 6, 2012 and Provisional Application No. 61/641,402, filed May 2, 2012, all of which are incorporated herein in their entireties by reference.

FIELD OF THE INVENTION

The present disclosure relates to liner-based storage and dispensing systems. More particularly, the present disclosure relates to liners for use with overpacks. More particularly, the present disclosure relates to an advantageous folding pattern for a liner that may be used with and inserted into an overpack.

BACKGROUND OF THE INVENTION

Numerous applications use liners for storing, shipping, and/or dispensing materials. One type of storage and dispense system includes a liner that is used with an overpack. For example, a liner may be filled with a material that may be stored, shipped and then dispensed at a later time. The liner may be a generally flexible liner that may be disposed within an outer container that may be more rigid and self-supporting than the liner. Typically, such a system requires that the liner be inserted into the outer container through the mouth of the outer container. Depending on the size of the mouth of the outer container, insertion of the liner may be difficult and/or may stress, or even significantly stress the liner during the insertion procedure. Stressing the liner may cause the liner to be weakened, damaged, or destroyed, resulting in a waste of time and/or materials. Accordingly, there is a need for a liner that may be relatively easy to insert into an outer container that places relatively little stress on the liner and is also relatively easier to insert.

BRIEF SUMMARY OF THE INVENTION

The present disclosure, in one embodiment, relates to a method for folding a liner for packaging and/or insertion into an overpack. The method may include providing a liner comprising a substantially tubular body portion and a closed top and bottom, and a fitment formed in or affixed to the top of the liner, forming a gusset in the bottom panel of the liner, forming a gusset in the body portion of the liner, and fan-folding the liner with the gusset in the bottom panel and the gusset on the body portion. In some embodiments, the top of the liner may be a substantially circular top panel and the bottom of the liner may be a substantially circular bottom panel, with the top panel being attached to one end of the tubular body portion and the bottom panel being attached to an opposite end of the tubular body portion. In such cases, the fitment may be affixed to the top panel of the liner. In other embodiments, the liner may be a flexible, blow molded liner, thereby having no weld seams. The liner may be fan-folded such that a width of the fan-folded liner, in some embodiments, is less than 5 inches, preferably less than 3 inches, and in some embodiments, down to 2 inches or less.

The tubular body portion may be comprised of one or more rectangular panels welded together to form a tube. In some such embodiments, the gusset in the body portion of the liner may be formed along a weld seam. The method may additionally include pulling the fitment and top of the liner away from the body portion prior to fan-folding. In other embodiments, the method may include folding the top of the liner over an outward side of the gusseted body portion, such that a first portion of the top of the liner is folded over a first side of the gusseted body portion and a second portion of the top of the liner is folded over a second side of the gusseted body portion, as will be described in further detail below. Such folding may permit the folded liner to have an overall height that is less than a height of the liner if expanded in an inflated or filled state, which can be advantageous when filling the liner to more effectively control unfolding of the liner. In additional embodiments, the fan-folded liner may be sterilized and/or vacuum packaged.

The present disclosure, in another embodiment, relates to a folded liner for packaging and/or insertion into an overpack. The folded liner may include a substantially tubular body portion and a closed top and bottom, and a fitment formed in or affixed to the top of the liner, a gusset formed in the bottom of the liner, and a gusset formed in the tubular body portion of the liner. The gusseted liner may be fan-folded along a length of the tubular body portion. In certain embodiments, the closed top of the liner may be a substantially circular top panel and the closed bottom of the liner may be a substantially circular bottom panel, the top panel being heat sealed to one end of the tubular body portion and the bottom panel being heat sealed to an opposite end of the tubular body portion. In other embodiments, the liner is a flexible, blow molded liner having no weld seams. In still further embodiments, pre-fold lines may be patterned in the liner during blow molding. The liner may be fan-folded such that a width of the fan-folded liner is less than 5 inches, preferably less than 3 inches, and in some embodiments, down to 2 inches or less. In some embodiments, the top of the liner is folded over an outward side of the body portion, such that a first half of the top of the liner is folded over a first side of the body portion and a second half of the top of the liner is folded over a second side of the body portion. If done properly, in some embodiments, the folded liner can have an overall height that is less than a height of the liner if expanded in an inflated or filled state. In additional embodiments, the folded liner may be sterilized and/or vacuum packaged in an outer packaging.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present invention. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to novel and advantageous liner-based storage and dispensing systems. More particularly, the present disclosure relates to novel and advantageous folding patterns for a liner that may be inserted into an overpack.

The liner may comprise one or more layers and may generally have any suitable thickness. In some embodiments, the overall thickness of the liner may be greater than the thickness of liners traditionally used with known overpacks. The liner may substantially conform to the shape of the overpack into which it is placed, in some embodiments. The conformal shape and/or the properties of the film comprising the liner (including the material used and/or the thickness of the liner) may advantageously provide the liner-based system with desirable characteristics, including but not limited to: increased dispensability; reduction or elimination of fold gas, pinholes, and/or weld tears; and/or a reduction in the load and stress on the liner fitment.

Example uses of liners and liner-based systems of the present disclosure may include, but are not limited to, transporting and dispensing ultrapure chemicals and/or materials such as photoresist, bump resist, cleaning solvents, TARC/BARC (Top-Side Anti-Reflective Coating/Bottom-Side Anti-Reflective Coating), low weight ketones and/or copper chemicals for use in such industries as microelectronic manufacturing, semiconductor manufacturing, and flat panel display manufacturing, for example. Additional uses may include, but are not limited to, transporting and dispensing acids, solvents, bases, slurries, cleaning formulations, dopants, inorganics, organics, metalorganics, TEOS, and biological solutions, pharmaceuticals, and radioactive chemicals. However, such liners may further be used in other industries and for transporting and dispensing other products such as, but not limited to, paints, soft drinks, cooking oils, adhesives, agrochemicals, health and oral hygiene products, and toiletry products, etc. Those skilled in the art will recognize the benefits of such liner-based systems and the process of manufacturing the liners, and therefore will recognize the suitability of the liners for use in various industries and for the transportation and dispense of various products.

In some embodiments, the liner of the present disclosure may be configured to be compatible in use with existing overpacks and/or dispensing systems. Accordingly, liners of the present disclosure may be designed to fit, and in some cases substantially easily fit within openings for existing overpacks or containers used in various industries.

Figure 1:
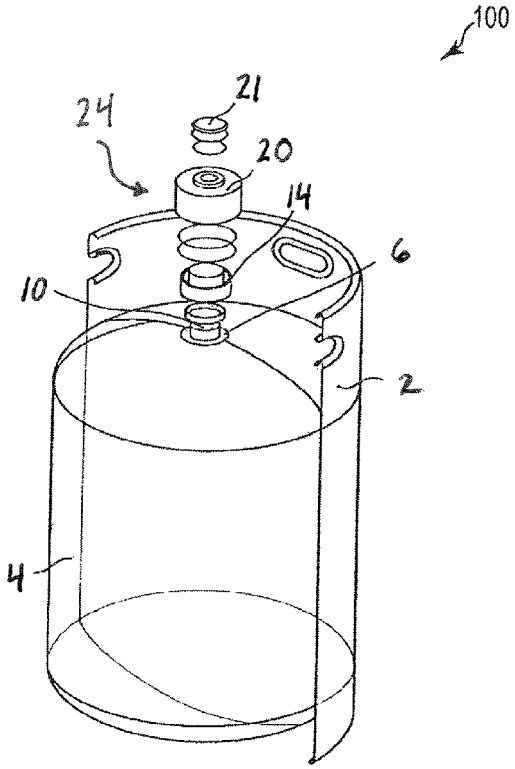
FIG. 1 is a cross-sectional view of a liner-based system in accordance with an embodiment of the present disclosure.

FIG. 1 shows one embodiment of the liner-based system of the present disclosure. The system 100 of FIG. 1 may include an overpack 2 and a liner 4. The overpack 2 may have a hollow interior capable of receiving a liner 4. In some embodiments the overpack 2 may include traditional overpacks such as existing drums or canisters used for storing and/or dispensing materials, including overpacks with larger mouth openings than that illustrated in FIG. 1 as well as overpacks wherein the entire lid or top opens, for example. In other embodiments, the overpack 2 may be designed to have a particular shape and/or size, including but not limited to a generally cylindrical, trapezoidal, rectangular, etc. shape. The overpack 2 in some embodiments such as that shown in FIG. 1 may have a substantially cylindrical or barrel-like shape and may have any suitable size, including any suitable circumference and/or height. The overpack 2 may be comprised of any suitable substantially rigid material, for example, but not limited to, metal, glass, wood, plastic, composites, corrugated materials, paperboard, or any other suitable material or combination of materials. Likewise, the overpack 2 may be manufactured using any process, such as stamping, machining, fabrication, injection blow molding, injection stretch blow molding, extrusion, etc. The overpack 2 may be manufactured as a single component or may be a combination of multiple components. In some embodiments, the overpack 2 may comprise known drums or canisters of 19 L, 40 L, or 200 L sizes, for example.

The overpack 2 may also include a closure and/or connecting assembly 24. In one embodiment, shown in FIG. 1, the closure and connecting assembly 24 may include a fitment retainer 14, a closure 20, and a shipping cap 21. In embodiments of the present disclosure that include an existing or known overpack 2, the closure and/or connecting assembly 24 that has traditionally been used with the overpack 2 may be used. Examples of such closures and/or connecting assemblies that may be used with some embodiments of the present disclosure are described in detail in International PCT Patent Application No. PCT/US11/56291, titled "Connectors for Liner-Based Dispense Containers," which was filed on Oct. 14, 2011 and U.S. patent application Ser. No. 12/982,160, titled "Closure/Connector for Liner-Based Dispense Containers," which was filed on Dec. 30, 2010, each of which is hereby incorporated by reference herein in its entirety. In other embodiments, the closure and/or connecting assembly 24 may be suitably adapted to connect with an overpack of any suitable size and/or shape.

The liner 4 of the system 100 may include a fitment 10 in some embodiments. The liner 4 may be any desired shape, including, but not limited to pillow shape, cylindrical, rectangular, cubical, trapezoidal, or any other suitable shape. In some embodiments, the liner, when it is in an expanded state, may substantially conform to the shape of the interior cavity of the overpack 2, as may be seen in FIG. 1. In other embodiments, however, the liner may be a slightly different size and/or shape than the overpack, or in other embodiments the liner may be a significantly different size and/or shape than the overpack. Examples of such non-conformal liners that may be used with embodiments of the present disclosure are described in International PCT Patent Application No. PCT/US11/55558, filed Oct. 10, 2011, and U.S. Patent Appln. No. 61/499,254, which are hereby incorporated by reference herein in their entirety. In a collapsed state or folded state, as will be described in further detail below, the liner 4 may be collapsed or be folded such that the liner 4 may fit through the overpack neck 6 of the overpack 2. The fitment 10 of the liner 4 may be configured such that when the liner 4 is inserted into the overpack 2, the fitment 10 of the liner 4 may nest inside of the fitment retainer 14 and/or the neck 6 of the overpack 2. In some embodiment, the fitment retainer 14 of the overpack 2 may detachably secure to the fitment 10 of the liner 4 and/or the neck 6 of the overpack 2, thereby supporting the liner in the overpack.

The fitment 10 of the liner 4 may be integral with the top portion of the liner 4. The fitment 10 may be sized and shaped such that the fitment 10 may be positioned inside of the fitment retainer 14 and/or the neck 6 of the overpack 2 and/or be compatible with some or all components of the closure and/or connector assembly 24 of the overpack 2. The fitment 10 may be comprised of any suitable material or combination of materials. For example, a suitably rigid plastic such as high density polyethylene (HDPE), linear low-density polyethylene (LLDPE), polytetrafluoroethylene (PTFE), and/or perfluoroalkoxy (PFA), may be used. In some embodiments, the fitment 10 may be comprised of a more rigid material than the rest of the liner 4. The fitment 10, in some embodiments may be securely sealed to the liner via welding or any other suitable method or combination of methods. In some embodiments, where for example the overpack includes a centrally-located mouth or opening, the fitment 10 may also be centrally located on the top panel of the liner to minimize stress on the fitment weld; however, central location of the fitment 10 on the top panel is not required. As discussed above, some embodiments of the liner of the present disclosure may be configured for use with known overpacks. In such embodiments, the fitment 10 of the liner 4 may be sized and shaped to be compatible with the closure and/or connector assembly 24 of a particular known overpack 2. Such known overpacks may be compatible, for example, with a liner fitment 10 having a ¾ inch to a 2 inch diameter, for example. It will be understood, however, that the liner fitment 10 may have any suitable diameter and/or shape and size such that it is compatible with a desired overpack 2. Examples of the types of liners, overpacks, fitments, connector/closure assemblies, and their uses are provided in more detail in PCT Patent Application No. PCT/US11/64141, entitled, "Generally Cylindrically-Shaped Liner for Use in Pressure Dispense Systems and Methods of Manufacturing the Same," filed Dec. 9, 2011, which is hereby incorporated by reference herein in its entirety.

Further examples of the types of liners, overpacks, fitments, connector/closure assemblies, and their uses are provided in more detail in PCT Patent Application No. PCT/US2008/085264, entitled, "Blow Molded Liner for Overpack Container and Method of Manufacturing the Same," filed Dec. 2, 2008, which is hereby incorporated by reference herein in its entirety. As disclosed therein, in some embodiments, a liner of the present disclosure may be a flexible, injection blow molded or injection stretch blow molded liner which avoids many disadvantages presented by traditional collapsible liner-based containers and has a low degree of waste during liner production. Unlike many traditional liners that are formed by welding films together with resultant folds or seams, these three-dimensional ("3D") liners may better conform to the interior of the overpack and may lower transportation induced failures. Such liners may preferably be flexible such that the liner wall may be readily collapsed, such as by vacuum, which may allow easy insertion of the liner into an overpack. The flexibility further allows the liner wall to be re-inflated upon insertion into the overpack. More specifically, the liner may be collapsed and re-inflated substantially without damage to the liner wall.

In some embodiments, the overall thickness of the liner may be thicker than traditional liners used with drum style overpacks, for example. One advantage of a liner with a thickness greater than traditional liners may be that the increased thickness can help prevent or reduce the occurrence of pin holes (small holes that can form in the liner), fold gas, weld tears, and/or gas diffusion that may occur during filling, storage, shipment, and/or dispense. The increased thickness of the liner may also help prevent choke-off during dispense.

While the overall thickness of embodiments of the present disclosure may be greater than that of traditional liners, the thickness may not be so great as to prevent the liner from being inserted into or extracted from the overpack through the neck of the overpack when the liner is in a collapsed state. Accordingly, any suitable thickness of the liner 4 is contemplated by the present disclosure. For example, in some embodiments, the liner 4 may have an overall thickness from about 80 to about 280 microns. In further embodiments, the liner 4 may have an overall thickness from about 100 to about 220 microns. In still other embodiments, the liner 4 may have an overall thickness from about 150 to about 200 microns. In still other embodiments, the liner 4 may have an overall thickness from about 100 to about 150 microns. However, even thicker liners may be used, particularly with overpacks having larger mouth openings than those illustrated as well as overpacks wherein the entire lid or top opens, for example. Notwithstanding the above describe dimensions, it will be understood that any suitable liner thickness may be used for the liners of the present disclosure, including down to or even less than 1 mil (25.4 microns) or up to and greater than 220 microns. As used here and throughout the present disclosure, ranges are used as a short hand for describing each and every value that is within the range; any value within the range can be selected as the terminus of the range.

The liner 4 of the present disclosure may comprise one, two, or more layers made from one or more suitable materials. In some embodiments, for example, the liner may consist of two or more layers, whereby the two or more layers may be made from the same material or may be made from different materials. Each of the one or more layers may have any suitable thickness. In some embodiments with two or more layers, each layer may have the same thickness, while in other embodiments, the two or more layers may have different thicknesses. In some embodiments, the one or more layers of the liner may be free of plasticizers, heat stabilizers, colorants, flame retardants, mold release agents (DMPS) and/or other microelectronic contaminants. Additional properties of one or more of the layers of the liners of the present disclosure are described in greater detail in PCT Patent Application No. PCT/US2011/64141, which was previously incorporated herein in its entirety.

The liner of the present disclosure may have a relatively simplistic design with a generally smooth outer and/or inner surface, or the liner may have a relatively complicated design, including, for example, but not limited to, pleats, ridges, indentations and/or protrusions. In one embodiment, for example, the liner may be textured to prevent choke-off, that is, the liner may be textured to prevent the liner from collapsing in on itself in a manner that would trap liquid within the liner and preclude the liquid from being dispensed properly.

The film comprising the liner of the present disclosure may be formed by any suitable process or combination of processes. For example, the film for the liner may be formed by co-extrusion, extrusion blow molding, injection blow molding, co-blow molding, dual blow molding, injection stretch blow molding, or any other suitable method or combination of methods. Examples of the types, properties, and methods of manufacturing the film and/or liner of the present disclosure are described in detail in International PCT Patent Application No. PCT/US11/55558, filed on Oct. 10, 2011, titled "Substantially Rigid Collapsible Liner, Container and/or Liner for Replacing Glass Bottles, and Enhanced Flexible Liners" and U.S. Patent Application No. 61/499,254 filed on Jun. 21, 2011, titled "Substantially Rigid Collapsible Liner, Container and/or Liner for Replacing Glass Bottles, and Flexible Gusseted or Non-Gusseted Liners," which are each hereby incorporated herein in its entirety.

In use, the liner 4 may be inserted into the overpack 2 when the liner 4 is in a collapsed state through the neck 6 of the overpack 2. Once the liner 4 has been positioned inside of the overpack 2, the liner 4 may be expanded to an expanded state. In some embodiments, the liner may be inflated with a clean gas, for example, but not limited to $N_2$, or clean dry air, prior to filling the liner with the desired material, while in other embodiments the liner may be expanded with the chemical to be filled. After the liner 4 has been filled with the desired material, the closure and/or connector assembly 24 of the overpack may be detachably secured to the fitment 10 of the liner 4. The system 100 may then be shipped to a desired location or stored until shipped. Upon arrival at a desired location, the contents of the liner 4 may be dispensed.

Figure 2A:
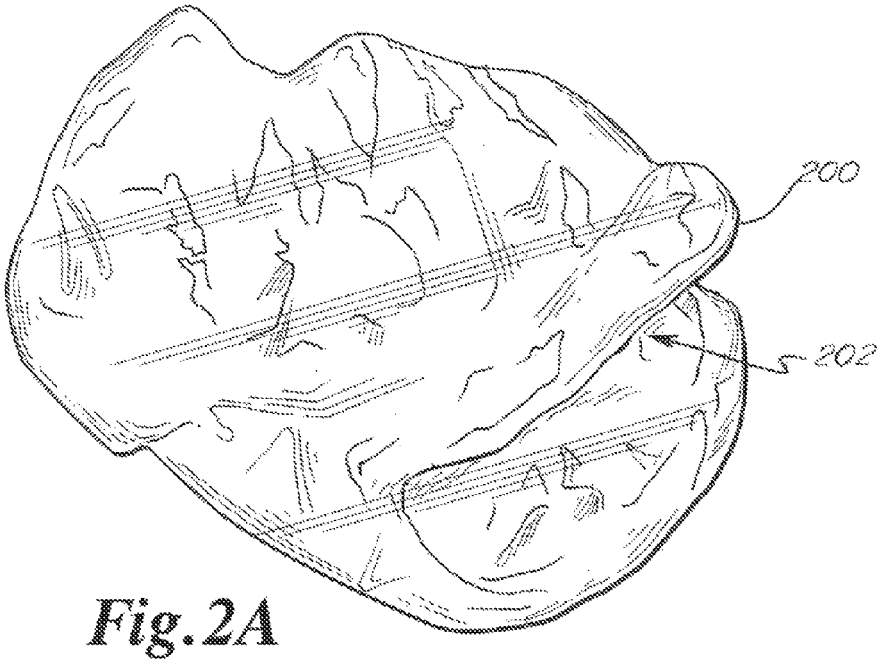
FIG. 2A is a perspective view of a liner with a bottom gusset fold in accordance with an embodiment of the present disclosure.
Figure 2B:
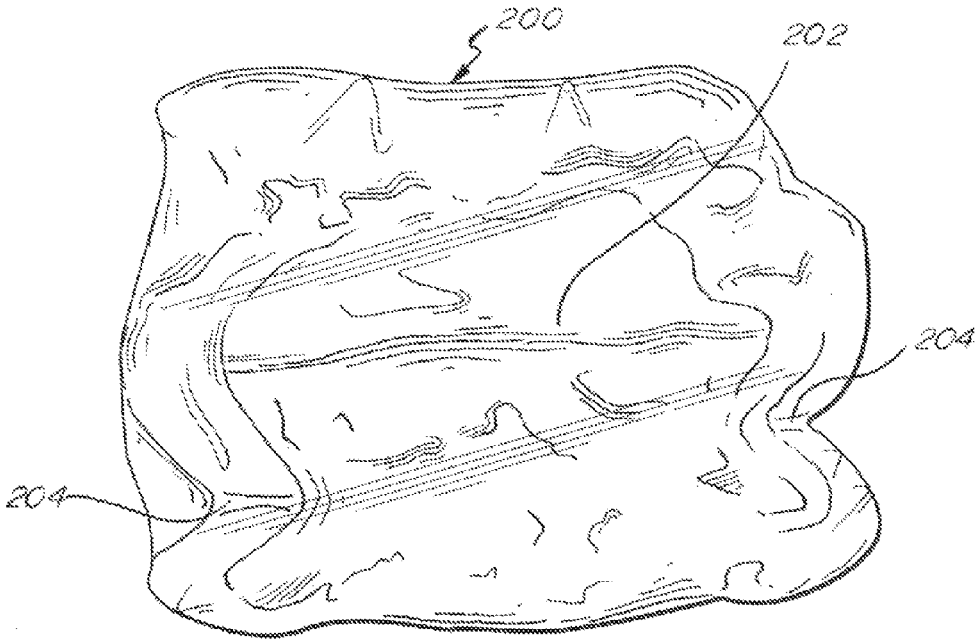
FIG. 2B is a perspective view of a liner with side gusset folds in accordance with an embodiment of the present disclosure.
Figure 2C:
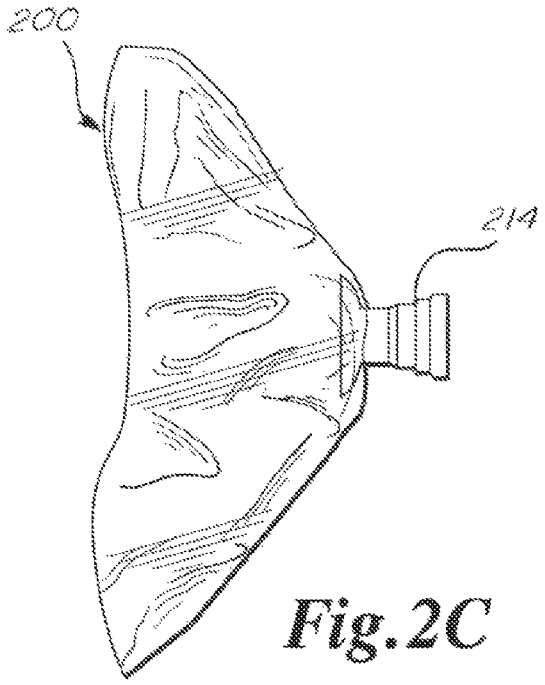
FIG. 2C is a perspective view of a folded liner with the fitment stretched outward in accordance with an embodiment of the present disclosure.
Figure 2D:
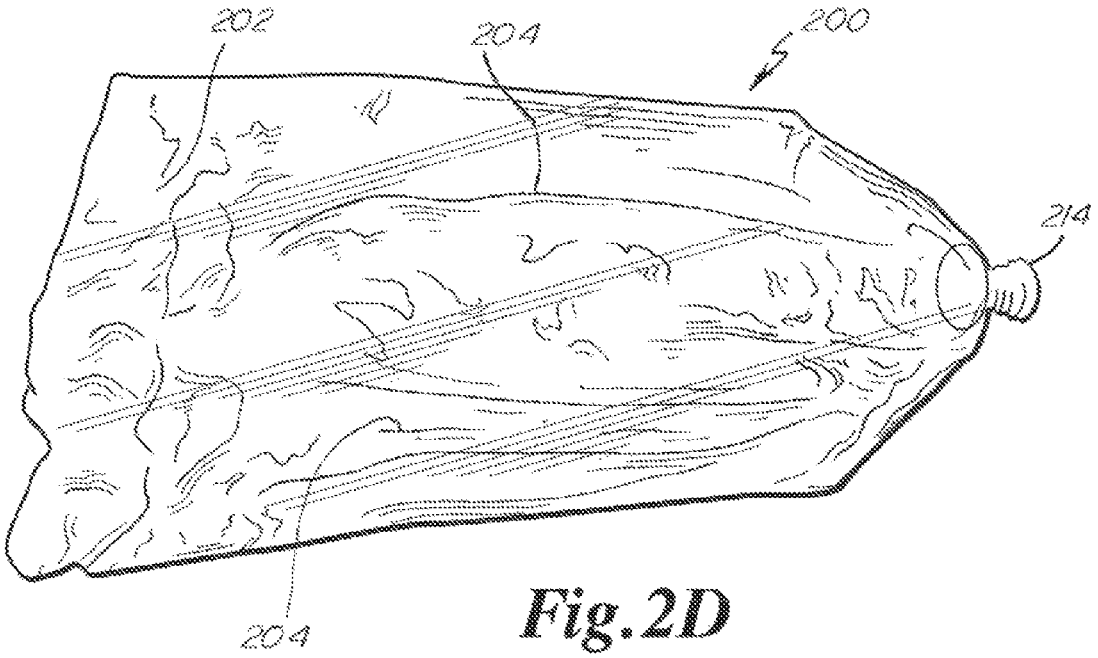
FIG. 2D is a perspective view of a folded liner that has been flattened in accordance with an embodiment of the present disclosure.
Figure 2E:
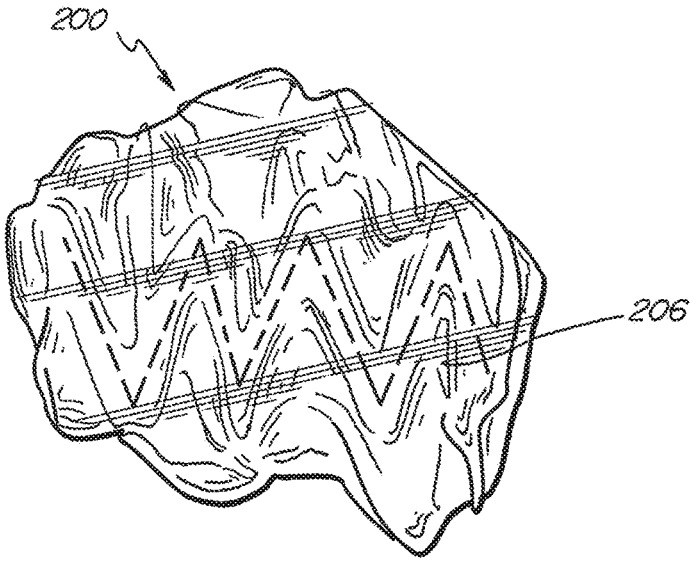
FIG. 2E is a perspective view of a fan-folded liner in accordance with an embodiment of the present disclosure.
Figure 2F:
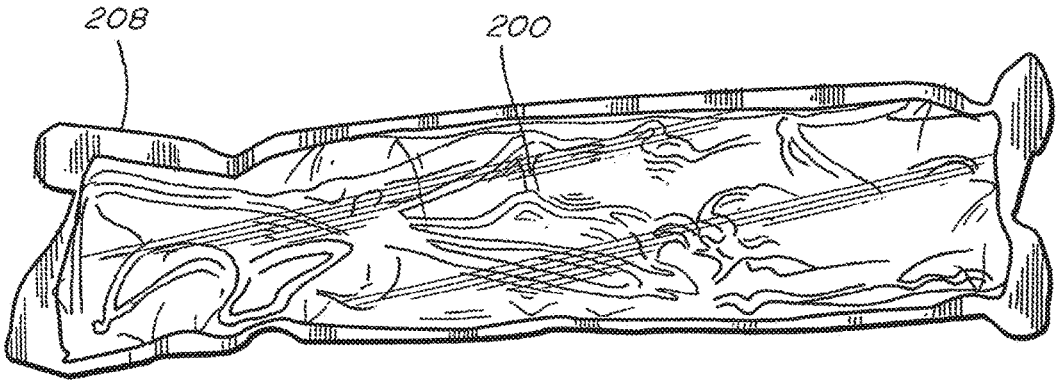
FIG. 2F is a perspective view of a packaged folded liner in accordance with an embodiment of the present disclosure.

Liners of the present disclosure may be relatively easier to insert into an overpack than traditional liners as a result of an advantageous method of folding the liner prior to insertion disclosed herein. FIGS. 2A-2F illustrate a process of folding a liner prior to insertion into an overpack according to one embodiment of the present disclosure. It will be understood that the terms bottom, top, upward, downward, etc. are not intended to limit the present disclosure, but are rather used to describe a particular embodiment. In one embodiment, and as shown in FIGS. 2A-2F, the liner may be a generally cylindrically-shaped liner that substantially conforms to the size and shape of an overpack when the liner is in an expanded state. The liner, therefore may have a body portion that may be generally tubular in shape with a top panel and a bottom panel attached thereto to form a cylinder with a generally enclosed interior, whereby the contents of the liner may be dispensed through a fitment attached to the top panel. Further details for such a liner and methods for manufacturing the same are provided in PCT Patent Application No. PCT/US11/64141, which was previously incorporated by reference in its entirety. As indicated above, alternative liners may include those flexible, blow-molded liners described in detail and manufactured in accordance with PCT Patent Application No. PCT/US2008/085264, which was previously incorporated by reference in its entirety. While the figures show a generally cylindrically shaped liner, it will be understood that other geometries are possible and are within the spirit and scope of the present disclosure. A folding pattern for a liner of the present disclosure may include a gusset 202 formed in the bottom panel of the liner 200. To form the gusset 202, the material at the bottom of the liner 200 may be tucked generally upward into the interior of the liner 200, as may be seen in FIG. 2A, which illustrates a perspective view of the liner 200. Similarly, one or more gussets 204 may be formed in the body portion of the liner, as may be seen in FIG. 2B, which illustrates a view from the bottom of the liner 200. While it does not make sense to speak of "sides" when referencing a cylindrical body portion, in some instances the body portion of the liner may be generally rectangular, or may have another geometry that creates sides in the body portion, in which case the body portion may have a plurality of "sides" disposed between the top panel and the bottom panel. In such cases, one or more of the sides may be gusseted. The gussets formed in the bottom of the liner and/or the body portion of the liner may be formed at welds or seams that have been created in the liner in some embodiments, while in other embodiments, the gussets may not be formed at welds or seams or at areas away from any welds or seams. The fitment 214 may then be pulled away from the body of the liner 200, as may be seen in FIG. 2C so that the fitment is positioned away from the body of the liner. The liner 200 may be substantially flattened or smoothed, as shown in FIG. 2D. Once the liner 200 has been smoothed, the liner may be folded or fan-folded into a generally fan-like, or accordion-like pattern 206, as may be seen in FIG. 2E, which illustrates a view of the liner from the bottom. The resulting width of the folded liner may be any desirable width such that the liner may be easily inserted into the mouth of an overpack. In some embodiments, the resulting width of the folded liner may be less than about 5 inches. In still other embodiments, the resulting width may be less than about 3 inches. In still further embodiments, the resulting width may be less than about 2 inches. In some embodiments, a user may fold the liner as such for insertion into an overpack, while in other embodiments the liner may be packaged, and in some embodiments vacuum packaged, in its folded state in an outer packaging 208, as may be seen in FIG. 2F for transportation, including sterile transportation. A plurality of folded packaged liners may be easily and effectively stored and/or shipped because of the advantageous flat shape of the liner. Depending on the intended use of the liner, the liner may be sterilized and packaged in a sterile manner.

The folded liner of the present disclosure may advantageously be easily inserted into the mouth of an overpack with minimal to no excess material building up at the insertion point of the overpack. The user may remove the folded liner from the package and insert it into the mouth of the overpack. The user may easily position the bottom panel end of the liner into the mouth of the overpack first and then slide the remainder of the liner into the mouth of the overpack. The fitment may remain outside of the mouth of the overpack or may couple to the mouth of the overpack, depending on the configuration of the fitment and/or mouth of the overpack. In contrast to the relatively easy insertion of the folded liner of the present disclosure, traditional liners tend to have excess material "bunch up" at the mouth of the liner during insertion, requiring a user to have to manually force the excess material into the mouth of the overpack. As discussed herein, some applications require that the liner be sterile, thus it is not desirable to increase the amount of stress the liner is subjected to. Further, while some applications may not require a sterile liner, the liner may still desirably be free of contaminants, such as liners that may be used to store foods or beverages, for example. Again, for such uses, it is desirable to minimize the amount of human or mechanical contact the liner is exposed to. Still further, regardless of the use of the liner, it is important to maintain the integrity of the liner. Handling a liner necessarily stresses the liner. Because folding the liner in accordance with the present disclosure prior to insertion in an overpack minimizes the amount of stress placed on the liner during insertion, the liners of the present disclosure may not be unnecessarily weakened, thereby minimizing the risk that a liner may be ripped, cut, or otherwise damaged during insertion.

Figure 3A:
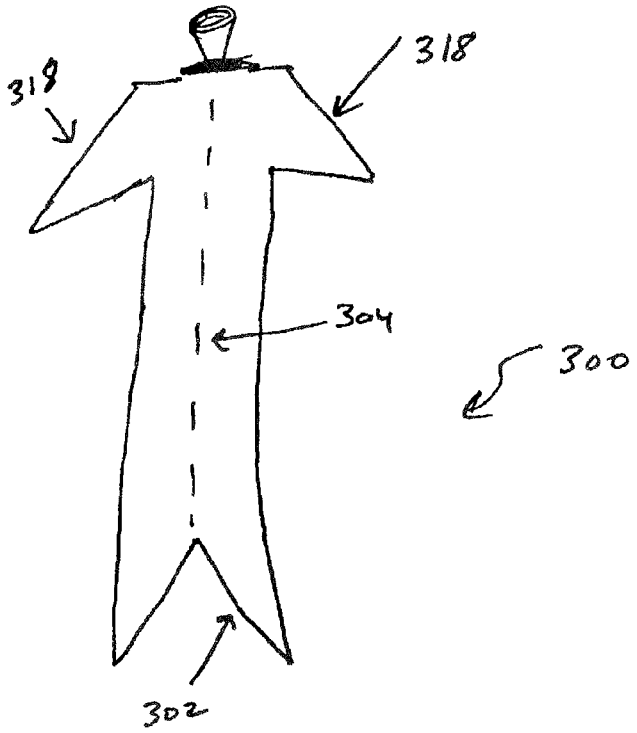
FIG. 3A is a cross-sectional view of a folded liner in accordance with another embodiment of the present disclosure.
Figure 3B:
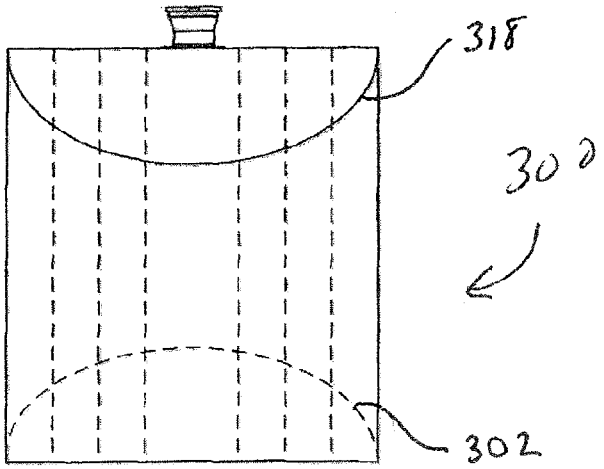
FIG. 3B is a plan view of a flattened liner illustrating one embodiment of a fan-folding pattern.

In another embodiment, a liner 300 may be folded such that the top of the liner is folded downward, as may be seen in FIG. 3 A. In this embodiment, the liner 300 may be folded to include a bottom gusset 302 and one or more gussets 304 formed in the body of the liner, as described above. As also described above, the liner may be substantially flattened or smoothed. Prior to flattening, during flattening, and/or post-flattening, a top portion 318 of the liner may be folded downward on outward sides of the gusseted body of the liner. As stated above, it does not always make sense to speak of "sides" when referencing a cylindrical body portion, and the liners of the present disclosure are certainly not limited to cylindrical body portions. However, as would be generally understood, the top portion 318 of the liner may be folded downward such that generally two substantially similar sized halves of the top portion fall on opposite sides of the flattened or smoothed liner. As illustrated, for example, the top portion of a substantially cylindrical liner may be folded such that two substantially similar sized semi-circular halves fall on opposite sides of the flattened liner. The fitment may remain in a position extending upward from the top of the liner, generally at the fold dividing the two substantially similar sized halves. While discussed with respect to the top portion being folded into two substantially similar sized halves, it is recognized that the two portions need not be similar in size, and that there could be more than two folded portions of the top portion, each of which may be similar or different in size. Similar to the previously described embodiment, once the liner 300 has been flattened, with the top portion folded downward over the body of the liner as generally illustrated in cross-section in FIG. 3A, the flattened or smoothed liner may then be fan-folded into a generally fan-like, or accordion-like pattern (similar to the fan-folded liner shown in FIG. 2E), for example, along the folding pattern illustrated in FIG. 3B. The resulting width of the folded liner may be any desirable width such that the liner may be easily inserted into the mouth of an overpack. In some embodiments, the resulting width of the folded liner may be less than about 5 inches. In still other embodiments, the resulting width may be less than about 3 inches. In still other embodiments, the resulting width may be less than about 2 inches. In some embodiments, a user may fold the liner as such for insertion into an overpack, while in other embodiments, the liner may be packaged in its folded state for transportation, including sterile transportation.

Figure 4A:
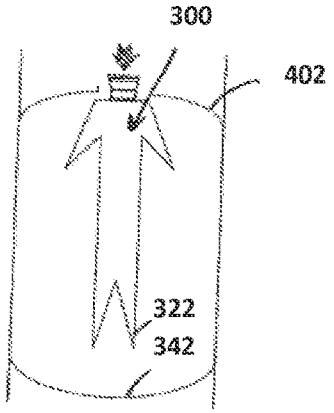
FIGS. 4A-4F are cut-away views showing how the liner of FIG. 3 A expands under pressure according to one embodiment of the present
Figure 4B:
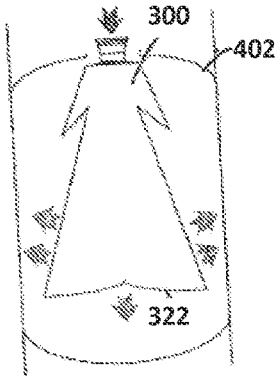
Figure 4C:
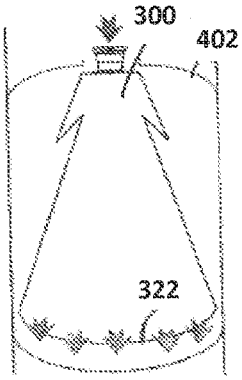
Figure 4D:
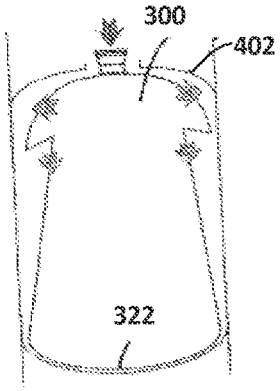
Figure 4E:
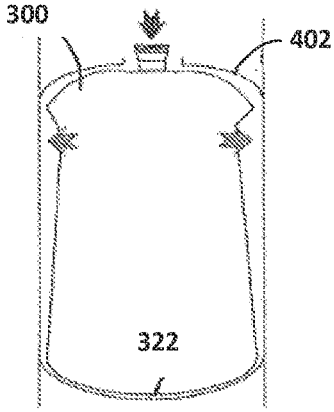
Figure 4F:
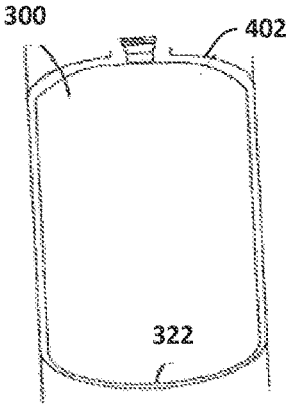

As is the case with the previously described embodiment, the folded liner may be inserted into an overpack with minimal to no excess bunching of liner material occurring at the mouth of the overpack. The user may easily position the bottom panel end of the liner into the mouth of the overpack first and then slide the remainder of the liner into the mouth of the overpack. The fitment may couple to the mouth of the overpack, depending on the configuration of the fitment and/or mouth of the overpack. FIG. 4A shows a liner 300 of the present embodiment inserted into an overpack 402. As may be seen, in some embodiments, an advantage of the present embodiment is that the folding pattern can be configured to ensure that the length of the folded liner is less than the height of the overpack, and thus, the bottom 322 of the liner may not initially reach the bottom 342 of the overpack. Once positioned within the overpack 402, a user may inflate the liner 300 using a clean dry gas for example, prior to filling the liner with a desired substance. In other cases, a user may initially inflate the liner within the overpack with the desired substance. FIGS. 4A-4F show how the liner may advantageously unfold upon inflation due to the folding pattern described herein. As may be seen, particularly in FIGS. 4A-4C, due to the folding pattern of the liner and the folded liner length being initially less than the interior height of the overpack, the bottom 322 of the liner may generally initially begin to unfold and extend toward the bottom 342 of the overpack, prior to the sides or top of the liner substantially extend and approach the sides or the top (respectively) of the overpack. Once the bottom 322 of the liner nears and/or reaches the bottom 342 of the overpack, where the liner can no longer extend in that direction, the sides and the top of the liner begin to more completely inflate and approach the walls of the overpack, as seen in FIGS. 4D-4F. The folding pattern of the present disclosure permits for liners configured to substantially conform to the shape of an overpack more substantially expand to an advantageous conforming shape. The expansion of a liner folded in such manner can have a predictable and/or repeatable folding and inflation pattern.

In some embodiments, fold lines or pre-folds generally defining the fold pattern or the fold bends of the liner may be manufactured into the liner to assist in proper folding of the liner. In particular embodiments, the pre-folds may be formed in the liner during blow-molding or stretch blow-molding of blow-molded liner embodiments, described in further detail above and in PCT Patent Application No. PCT/US2008/085264, which was previously incorporated by reference herein. In order to manufacture embodiments of containers having such fold lines or pre-fold patterns according to the present disclosure by blow molding, one manufacturing method may include blow molding the container in a mold that is modeled at some intermediate state between a fully expanded or fully collapsed state of the resulting container. Blow molding the container in a mold at this intermediate state may assist in the formation of the fold lines or patterns.

The contents of the liners of the present disclosure may be dispensed by any known and desired method, including, for example, direct or indirect pressure dispense, pressure assisted pump dispense, pump dispense, or any other method. Further details of the types of dispense, closure/connector assemblies, and related dispense components that may be used in combination with the liner-based systems disclosed herein are provided in International Patent Application No. PCT/US11/64141, which was previously incorporated by reference herein in its entirety.

The amount of pressure required to dispense the contents of a liner of the present disclosure may depend on the force required to collapse the liner, which may be dependent on the thickness and/or composition of the liner. In some embodiments, the contents of the liner may be dispensed at any suitable pressure. For example in one embodiment, the contents may be dispensed at from about 7 psig to about 30 psig.

In further embodiments, the liner-based system of the present disclosure may be configured such that it is compatible with the NOWPak® pressure dispense system, such as that disclosed in U.S. patent application Ser. No. 11/915,996, titled "Fluid Storage and Dispensing Systems and Processes," which was filed Jun. 5, 2006, the contents of which are hereby incorporated by reference in their entirety herein. A sample of a misconnect prevention connector that may be used with the liner-based system of the present disclosure may be that of ATMI of Danbury, Conn., or those disclosed in International Patent Application No. PCT/US07/70911, filed on Jun. 11, 2007; U.S. Patent Application No. 60/813,083, filed on Jun. 13, 2006; U.S. Patent Application No. 60/829,623, filed on Oct. 16, 2006; and U.S. Patent Application No. 60/887,194, filed on Jan. 30, 2007, which are all hereby incorporated herein by reference in their entirety.

Some embodiments of the present disclosure may further include components or methods for further reducing or eliminating choke-off. Choke-off may be described as what occurs when a liner necks and ultimately collapses on itself, or a structure internal to the liner, to form a choke point disposed above a substantial amount of liquid. A variety of ways of preventing or handling choke-off are described in PCT Application Number PCT/US08/52506, entitled, "Prevention Of Liner Choke-off In Liner-based Pressure Dispensation System," with an international filing date of Jan. 30, 2008, which is hereby incorporated herein by reference in its entirety, and PCT Application Number PCT/US11/64141, which was previously incorporated herein in its entirety. Additional examples of components and/or methods for limiting or eliminating choke-off are also described in detail in International Patent Application No. PCT/US11/55558 and U.S. Patent Application No. 61/499,254, which were previously incorporated by reference herein.

Although the present invention has been described with reference to preferred embodiments, persons skilled in the art will recognize that changes may be made in form and detail without departing from the spirit and scope of the invention.

The invention claimed is:

1. A method for folding a liner for packaging and/or insertion into an overpack, the method comprising:

providing a liner comprising a substantially tubular body portion and a closed top and bottom, and a fitment at least one of formed in or affixed to the top of the liner;

forming a gusset in the bottom panel of the liner;

fan-folding the liner after forming the gusset in the bottom panel wherein the fan-folding is symmetrical about the fitment.

2. The method of claim 1, wherein the top of the liner comprises a substantially circular top panel and the bottom of the liner comprises a substantially circular bottom panel, the top panel being attached to one end of the tubular body portion and the bottom panel being attached to an opposite end of the tubular body portion, and wherein the fitment is affixed to the top panel of the liner.

3. The method of claim 1, wherein the liner is a flexible, blow molded liner.

4. The method of claim 2, wherein the liner is fan-folded such that a width of the fan-folded liner is less than 5 inches.

5. The method of claim 4, wherein the liner is fan-folded such that a width of the fan-folded liner is less than 3 inches.

6. The method of claim 5, wherein the liner is fan-folded such that a width of the fan-folded liner is less than 2 inches.

7. The method of claim 2, wherein the tubular body portion comprises at least one rectangular panel welded together to form a tube and a gusset formed in the body portion of the liner is along a weld seam.

8. The method of claim 1, further comprising pulling the fitment and top of the liner away from the body portion.

9. The method of claim 1, further comprising forming a gusset in the body portion of the liner before fan-folding the liner.

10. The method of claim 1, further comprising vacuum packaging the fan-folded liner in an outer packaging.

11. A method for folding a liner for packaging and/or insertion into an overpack, the method comprising:

providing a liner comprising a substantially tubular body portion and a closed top and bottom, and a fitment at least one of formed in or affixed to the top of the liner;

forming a gusset in the bottom panel of the liner;

forming a gusset in the body portion of the liner; and fan-folding the liner after forming the gusset in the bottom panel and after forming the gusset on the body portion and further comprising folding the top of the liner over an outward side of the gusseted body portion, such that a first portion of the top of the liner is folded over a first side of the gusseted body portion and a second portion of the top of the liner is folded over a second side of the gusseted body portion.

12. The method of claim 11, wherein the folded liner has an overall height that is less than a height of the liner if expanded in an inflated or filled state.

13. The method of claim 11, wherein the first portion and second portion of the top of the liner are substantially similar in size, thereby dividing the top of the liner substantially in half.

14. The method of claim 13, further comprising sterilizing the fan-folded liner.

15. A folded liner for packaging and/or insertion into an overpack, the folded liner comprising:

a substantially tubular body portion and a closed top and bottom, and a fitment at least one of formed in or affixed to the top of the liner;

a gusset formed in the bottom of the liner; and wherein the gusseted liner is fan-folded along a length of the tubular body portion and symmetrically about the fitment.

16. The folded liner of claim 15, wherein the closed top of the liner comprises a substantially circular top panel and the closed bottom of the liner comprises a substantially circular bottom panel, the top panel being heat sealed to one end of the tubular body portion and the bottom panel being heat sealed to an opposite end of the tubular body portion.

17. The folded liner of claim 15, wherein the liner is a flexible, blow molded liner having no weld seams.

18. The folded liner of claim 17, further comprising pre-fold lines patterned in the liner during blow molding.

19. The folded liner of claim 15, wherein the folded liner is sterilized and vacuum packaged in an outer packaging.

20. The folded liner of claim 15, further comprising a gusset formed in the tubular body portion of the liner.

21. A folded liner for packaging and/or insertion into an overpack, the folded liner comprising:

a substantially tubular body portion and a closed top and bottom, and a fitment at least one of formed in or affixed to the top of the liner;

a gusset formed in the bottom of the liner; and a gusset formed in the tubular body portion of the liner;

wherein the gusseted liner is fan-folded along a length of the tubular body portion wherein the top of the liner is folded over an outward side of the body portion, such that a first about half of the top of the liner is folded over a first side of the body portion and a second about half of the top of the liner is folded over a second side of the body portion.

22. The folded liner of claim 21, wherein the folded liner has an overall height that is less than a height of the liner if expanded in an inflated or filled state.

* * * * *